US008549688B2

(12) United States Patent
Leitner et al.

(10) Patent No.: US 8,549,688 B2
(45) Date of Patent: Oct. 8, 2013

(54) METHOD FOR PRODUCING SHOES, STRIPS THEREFOR AND SHOE

(75) Inventors: Johann Leitner, Bichlbach (AT); Alois Pieber, Hohenzell (AT); Franz Josef Resch, Schladming (AT)

(73) Assignee: Fischer Sports GmbH, Ried/Innkreis (AT)

( * ) Notice: Subject to any disclaimer, the term of this patent is extended or adjusted under 35 U.S.C. 154(b) by 602 days.

(21) Appl. No.: 12/682,679

(22) PCT Filed: Oct. 10, 2008

(86) PCT No.: PCT/AT2008/000367
§ 371 (c)(1),
(2), (4) Date: Apr. 12, 2010

(87) PCT Pub. No.: WO2009/046477
PCT Pub. Date: Apr. 16, 2009

(65) Prior Publication Data

US 2010/0236101 A1 Sep. 23, 2010

(30) Foreign Application Priority Data

Oct. 12, 2007 (AT) ..... 1636/2007

(51) Int. Cl.
*A43B 7/18* (2006.01)

(52) U.S. Cl.
USPC ..... 12/114.2; 36/88; 36/93; 36/117.1

(58) Field of Classification Search
USPC ..... 12/133 R, 114.2, 114.6, 115.6, 115.8, 12/116.2, 134; 36/88, 93, 117.1
See application file for complete search history.

(56) References Cited

U.S. PATENT DOCUMENTS

| | | | | |
|---|---|---|---|---|
| 934,556 | A | 9/1909 | Malmberg | |
| 1,117,818 | A | 11/1914 | Ellmann | |
| 3,848,286 | A | 11/1974 | Kahmann | |
| 4,060,869 | A * | 12/1977 | Brown | 12/115.2 |
| 4,433,494 | A * | 2/1984 | Courvoisier et al. | 36/117.6 |
| 4,512,052 | A | 4/1985 | Bruno | |
| 4,964,229 | A * | 10/1990 | Laberge | 36/93 |
| 5,632,057 | A * | 5/1997 | Lyden | 12/146 B |
| 5,714,098 | A * | 2/1998 | Potter | 264/40.1 |
| 5,732,428 | A | 3/1998 | Brown | |
| 5,875,504 | A | 3/1999 | Tambling | |
| 6,732,455 | B2 * | 5/2004 | Bordin et al. | 36/89 |

(Continued)

FOREIGN PATENT DOCUMENTS

| | | |
|---|---|---|
| CH | 530251 A | 11/1972 |
| DE | 8611889 U1 | 10/1986 |
| DE | 3805721 A1 | 12/1988 |

(Continued)

*Primary Examiner* — Marie Patterson
(74) *Attorney, Agent, or Firm* — Laurence A. Greenberg; Werner H. Stemer; Ralph E Locher

(57) ABSTRACT

A method for producing a shoe that can be adapted to the foot of a wearer, is made of hard, thermoplastic synthetic material and is worn for sports, includes heating a prefabricated shoe at least in sections and adapting the shoe by applying pressure from the outside and by shaping the heated area. The shoe is then cooled, a correction strip, which is made of a hard material and is taken from the foot, is introduced in to the prefabricated shoe and the heated shoe is pressed onto the correction strip by applying pressure. A strip correction and a shoe are also provided.

11 Claims, 10 Drawing Sheets

(56) References Cited

U.S. PATENT DOCUMENTS

| | | | | |
|---|---|---|---|---|
| 7,287,293 | B2 * | 10/2007 | Cook et al. | 12/133 R |
| 2004/0134104 | A1 * | 7/2004 | Shor | 36/88 |
| 2007/0033750 | A1 * | 2/2007 | Cook et al. | 12/134 |
| 2007/0200264 | A1 | 8/2007 | Prutzman et al. | |
| 2008/0000109 | A1 * | 1/2008 | Challande | 36/117.1 |
| 2008/0104778 | A1 * | 5/2008 | Drake et al. | 12/146 R |
| 2009/0183390 | A1 * | 7/2009 | Miller et al. | 36/91 |

FOREIGN PATENT DOCUMENTS

| | | | |
|---|---|---|---|
| DE | 4224827 | A1 | 1/1994 |
| EP | 1872678 | A2 | 1/2008 |
| FR | 2736515 | A1 | 1/1997 |
| GB | 2116831 | A | 10/1983 |

* cited by examiner

Fig. 6.1

METHOD FOR PRODUCING SHOES, STRIPS THEREFOR AND SHOE

BACKGROUND OF THE INVENTION

Field of the Invention

The invention generally relates to the production of shoes made out of hard synthetic material and is worn for sports, that is, shoes, in particular encompassing a hard, resistant outer shell made out of thermoplastic synthetic material.

In detail, the invention relates to a method for producing a shoe that can be adapted to the foot of a wearer and that is made out of hard, thermoplastic synthetic material and that is worn for sports, wherein a prefabricated shoe is heated at least in sections and is adapted by applying pressure from the outside and by shaping the heated area. The shoe is then cooled down.

The invention further relates to a strip for carrying out the method as well as to a sports shoe or hard shell shoe, respectively, that can be used as a prefabricated shoe in such a method or that was produced according to such a method, respectively.

Synthetic material shoes that are worn for sports, such as ski boots for downhill skiing or cross-country skiing, are typically made out of synthetic material by means of injection molding. A completion of cross-country ski boots by injecting a shoe sole that includes binding parts onto already prefabricated shoe parts is known from FR 2736515 A. Another type of production is described in CH 530 251 A5, wherein two shoe halves are produced in the method known therefrom by deforming synthetic material plates. The two shoe halves are subsequently joined by welding the synthetic material or also by means of adhesion. An individual fit is not provided thereby.

It is also known from DE 42 24 827 A1 to produce an impression of a part of a body, e.g. of a foot, for the production of an individual piece of clothing, e.g. of a shoe, wherein films are placed around the foot or body part in general, the space between the film and the foot is evacuated and a further film is subsequently applied on top, wherein the space between the two films is then evacuated and the second film is adhered to the first film. The cavity defined by the two films can then be filled with plaster, e.g., so as to obtain the desired impression that can be used as a mold, for instance for a shoe.

In the case of the production of shoes made out of thermoplastic synthetic material, in particular by means of injection molding, it is generally common to create a shoe for a certain shoe size. Oftentimes, however, such a commonly formed shoe does not fit the individual feet of wearers, because feet have different widths, for example in the area of the ball of the toes, or also insteps of varied heights and/or because they can encompass other differences. On principle, it is thus possible to produce the shoes in each case in a custom-made fashion according to the respective shape of the foot (see the above-mentioned DE 42 24 827 A1), which, however, is altogether very extensive and expensive.

On the other hand, U.S. Pat. No. 3,848,286 A already proposed a method in the case of which a shoe, concretely a ski boot, is prefabricated out of thermoplastic synthetic material. Such a prefabricated ski boot is then individually adapted to the respective foot of a wearer in that—after putting on the shoe—the shaft of the shoe is closed relative to the leg of the wearer as air-tightly as possible. After this, the interior of the shoe is evacuated by means of lines that extend through the seal closure or that are connected to an opening in the subshell of the shoe. Heat is furthermore applied to the outside of the shoe and the shoe is pressed against the foot of the wearer and is individually adapted thereto by the higher external air-pressure as compared to the interior of the shoe in response to the corresponding heating of the shoe beyond the softening point of the thermoplastic shoe material. Among other things, it is disadvantageous here that the shoe is to be provided with an evacuation opening and that it is furthermore difficult to tightly close the shaft on the leg, in particular when the wearer wears a so-called thermo-sock for thermally insulting the foot in the shoe, so that only a slight low pressure can be generated in the interior of the shoe, whereby the pressure difference between exterior and interior of the shoe is so small that a good adaptation of the shoe to the foot may possibly be prevented.

BRIEF SUMMARY OF THE INVENTION

It is now the object of the invention to provide for a production of an adapted shoe, that is, an individual adaptation of a shoe to a foot of a wearer, in a simple and reliable manner, wherein in particular an evacuation opening in the shoe may no longer be necessary and a relatively high pressure difference between exterior and interior of the shoe can nonetheless be attained for the deformation of the shoe so as to adapt it to a foot. In so doing, it is supposedly possible to use only a single average tool strip in response to the production of the prefabricated shoe, that is, different general strips should be superfluous as far as possible, even in the case of a given shoe size.

The solve the posed object, the method of the afore-specified type according to a first aspect of the invention is characterized in that a correction strip that is made out of hard material and that is taken from the foot is introduced into the prefabricated shoe and that the heated shoe is pressed onto the correction strip by applying pressure.

In response to the use of such a correction strip that is individually adapted to the foot of the respective wearer, provision can be made for a comparatively good seal as well as for the use of a comparatively higher temperature for the hot deformation, so that the desired adaptation of the shoe is made possible in a simple and efficient manner in response to external pressure application.

In the case of ski boots (for downhill skiing as well as for cross-country skiing), the sole area of the boot has a predetermined function with reference to the interaction with binding parts on the ski, so that the sole area should not be deformed any longer as far as possible in response to the adaptation-deformation of the boot. In this respect, it is thus further advantageous according to the instant invention when a material comprising a higher softening temperature, e.g. 170°, is used for the sole area of the boot than is used for the remaining area of the shoe, e.g. a shell and a cuff.

To provide for an accurate individual adaptation to the foot in the case of a correction strip, it is also advantageous when a base correction strip is produced that is provided with holes at the neuralgic spots, with molded elastic parts being inserted into said holes.

So as to be able to transfer corresponding forces from the leg via the shoe in the case of a sports shoe, in particular ski boot, when engaging in a sport, it is advantageous to provide for a fit that is as tight as possible at certain parts of the foot, whereas a rather comfortable fit of the foot in the boot is desired for other sports. In this context is has thus also proven to be advantageous to use a correction strip that is narrower than the measured human foot between the navicular bone (os naviculare) at the inside of the foot or the base bump at the outside of the foot, respectively, on the one hand, and the area of the ball of the large toe or the area of the ball of the small toe, respectively, on the other hand. On the other hand, it is advantageous here when provision is made in the area of the ball of the toes for an excess and/or when a free space is available in the area of the toes. It is also advantageous for the use as ski boot for downhill skiing when the correction strip encompasses an axis under an angle relative to a vertical axis so as to be able to lean forward.

The afore-mentioned base correction strip can in particular also be produced to simplify the method for each shoe size. However, only a few base correction strips can also be produced for each shoe size. Following the creation of the base correction strip, the mentioned individual adaptation is carried out by inserting the molded elastic parts.

It has further proven to be particularly advantageous for the creation of the correction strip when the shape of the correction strip is obtained by scanning the foot of the respective wearer by means of a digitizing camera and by processing the obtained data in a computer.

It has also proven to be advantageous for a simple pressure application or creation of a pressure differential between exterior and interior of the shoe, for a film to be placed over the entire prefabricated shoe and the correction strip and for it to be closed, for the interior of the film to be evacuated and for the shoe to thus be pressed onto the correction strip and for the shoe to be removed after a dwell period for the solidification of the synthetic material.

In a comparable manner, the invention provides for a method for producing a shoe that can be adapted to the foot of a wearer and that is made out of hard, thermoplastic synthetic material, and is worn for sports, wherein a prefabricated shoe located on the foot is heated at least in sections and is adapted by applying pressure from the outside and by shaping the heated area, whereupon the shoe is cooled. According to the invention, this method is characterized in that, similarly as in the case of the afore-mentioned method, a film is placed over the entire prefabricated shoe, said film being closed in the area of the calf, the interior of the film being evacuated and the shoe thus being pressed onto the foot, whereupon the shoe is removed after a dwell time for the solidification of the synthetic material.

For carrying out the method according to the invention, the invention furthermore provides for a strip that is formed as a correction strip that is made out of hard material and that is taken from the foot of the wearer. In the case of this strip, it is particularly advantageous when the distance between the navicular bone (os naviculare) at the inside of the foot or the base bump at the outside of the foot, respectively, and the area of the ball of the large toe or the area of the ball of the small toe, respectively, is narrower than the measured human foot. It is furthermore advantageous when it is provided as base correction strip for a shoe size and when it is provided with holes at the neuralgic spots, with molded elastic parts being capable of being inserted into said holes. It is also advantageous when an excess is available in the area of the ball of the toes and/or when a free space is available in the area of the toes. It is furthermore advantageous for downhill skiing when the correction strip encompasses an axis that is inclined about an angle relative to a vertical axis so as to be able to lean forward.

As mentioned, the invention also provides for a hard shell shoe for the use in the instant method or produced according to the instant method, respectively, wherein provision is made for a subshell and for a cuff made out of synthetic material and for subshell and cuff in detail to be made out of different synthetic material. Such a hard shell shoe is in particular provided for a method or according to a method as mentioned above, respectively, with said hard shell shoe encompassing a subshell and a cuff made out of thermoplastic synthetic material, wherein at least one area of the subshell is made out of synthetic material comprising a higher softening temperature than that of the remaining area of the subshell and of the cuff.

BRIEF DESCRIPTION OF THE SEVERAL VIEWS OF THE DRAWING

The invention will be defined in more detail below by means of preferred exemplary embodiments, to which it is not to be limited to, however, and with reference to the drawings. In detail:

FIG. 6.1 shows a sectional view through the shoe of FIG. 6 according to line VI-VI in FIG. 6 comprising an inserted correction strip;

DESCRIPTION OF THE INVENTION

Figure 1:
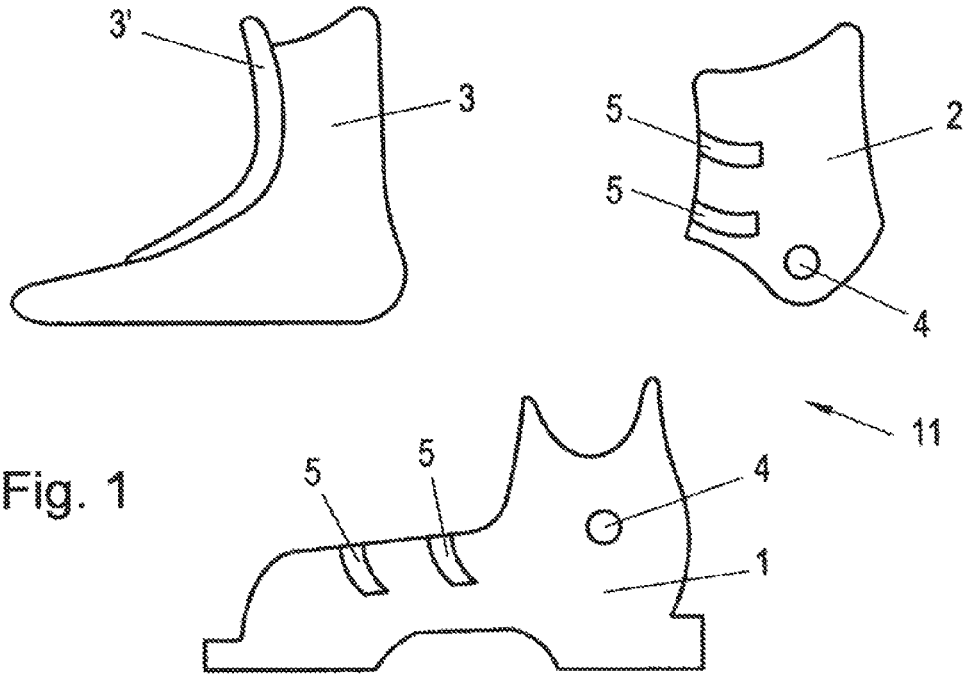
FIG. 1 shows the individual parts of a prefabricated, inherently known ski boot.
Figure 2:
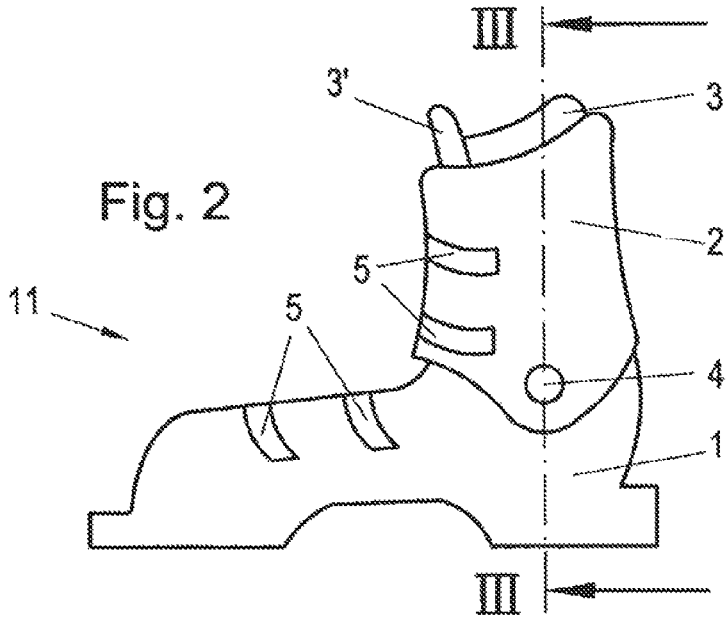
FIG. 2 shows this known, prefabricated shoe in the assembled state in a side view.

The inherently known shoe 11 according to FIGS. 1 and 2 substantially consists of a subshell 1, a cuff 2, an inner shoe 3 comprising a so-called tongue 3' and a joint 4 that connects the cuff 2 to the subshell 1 in an articulated manner. Buckles 5 serve to close the shoe 11.

Figure 3:
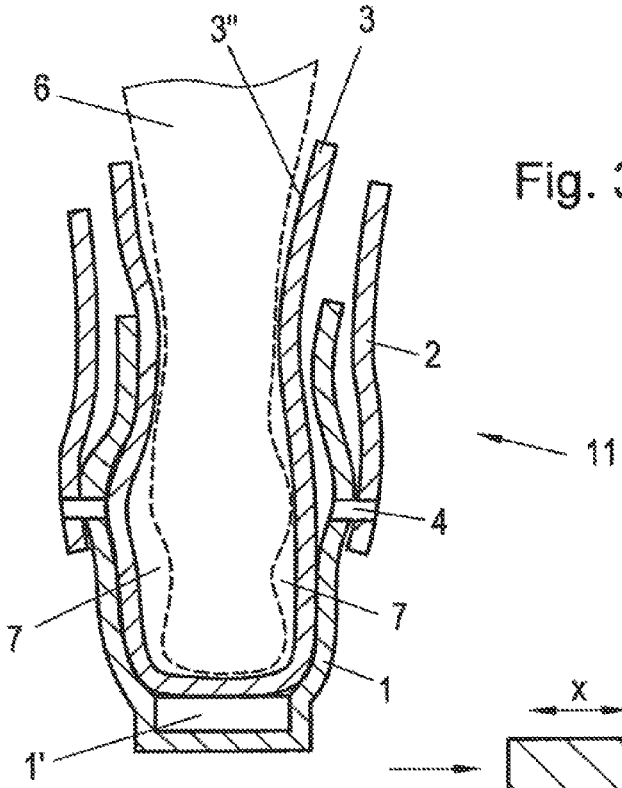
FIG. 3 shows a section through this shoe according to line III-III in FIG. 2.

The outline of a human foot 6 in such a shoe 11 is shown in FIG. 3 by means of dashed lines. Said foot is more or less located within the inner shoe 3 on the inner wall 3" thereof. This often leads to the formation of cavities 7, in particular below the ankles.

Figure 4:
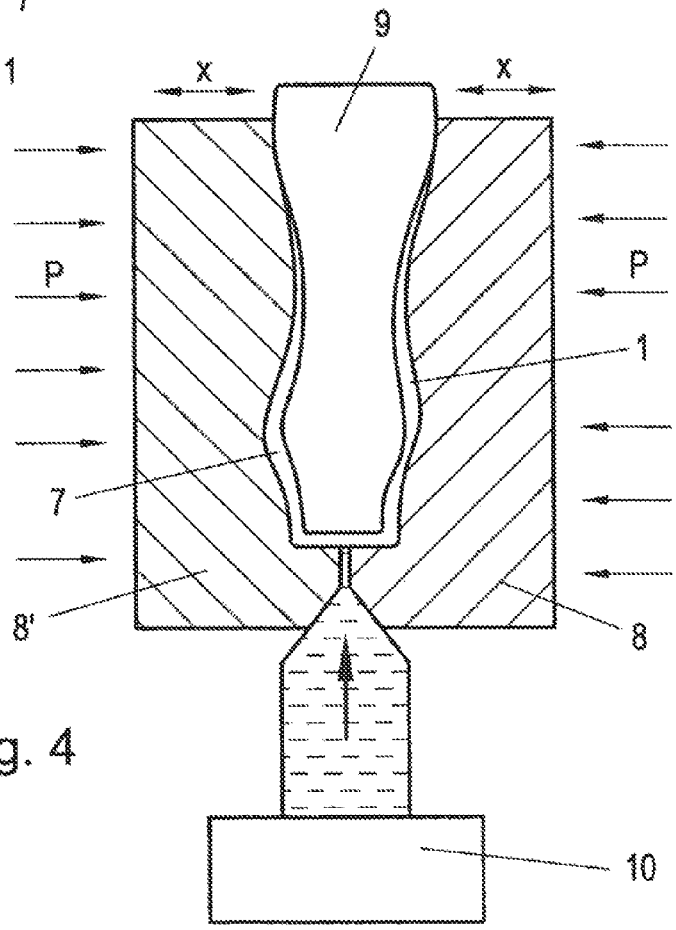
FIG. 4 shows, schematically in a sectional view, the production of such a shoe by means of injection molding using a molded strip.

The production of the subshell 1 is carried out by means of an injection molding process. An injection molding tool consisting of two mold halves 8 or 8', respectively, (see FIG. 4) that can be moved towards one another and away from one another in the direction of double arrows x and that are closed by applying pressures that are indicated by means of arrow P, is used hereby.

A so-called molded strip or last 9 that encompasses a different contour than the two mold halves 8 and 8' in certain areas, whereby a cavity is formed that is filled with liquid synthetic material from an injection molding machine 10, is integrated within the tool that consists of the mold halves 8, 8'. The subshell 1 is formed after the liquid synthetic material in the cavity 7 has cooled down.

The cuff 2 is produced in an analogous manner.

This method, in particular the production of the mold halves 8 and 8' and of the molded strip or last 9 is extensive when individually adapted shoes are to be created with it.

To provide for an economical production of shoes, as is known from the shoe making for a custom-made shoe, the molded strip or last 9 is designed to an average shoe size or foot shape, respectively, so as to provide the possibility of being able to use the shoe for as many wearers as possible. In view of the differences in the case of individual foot shapes, provision is made in the inner shoe 3 for deformable pads, so as to ensure a contact to the external shell on the one hand and so as to form a certain crush zone on the other hand, so as to avoid painful pressure marks on the foot. However, this has the disadvantage that relatively soft zones are created, wherein the transfer of force from the foot to the sports equipment is impaired.

Provision is thus made for a shell that is made out of synthetic material and that can be produced on an average tool strip to be adapted to an individual foot. By means of such a retroactive individual, correct fit, the human foot has good contact to the external shell when engaging in sports, wherein forces created when engaging in sports, for example when skiing, are transferred well between foot and sports equipment.

According to FIGS. 5 and 6, an individual correction strip that is subsequently used to adapt-reshape the shoe using heat and pressure is created for this adaptation.

Figure 5:
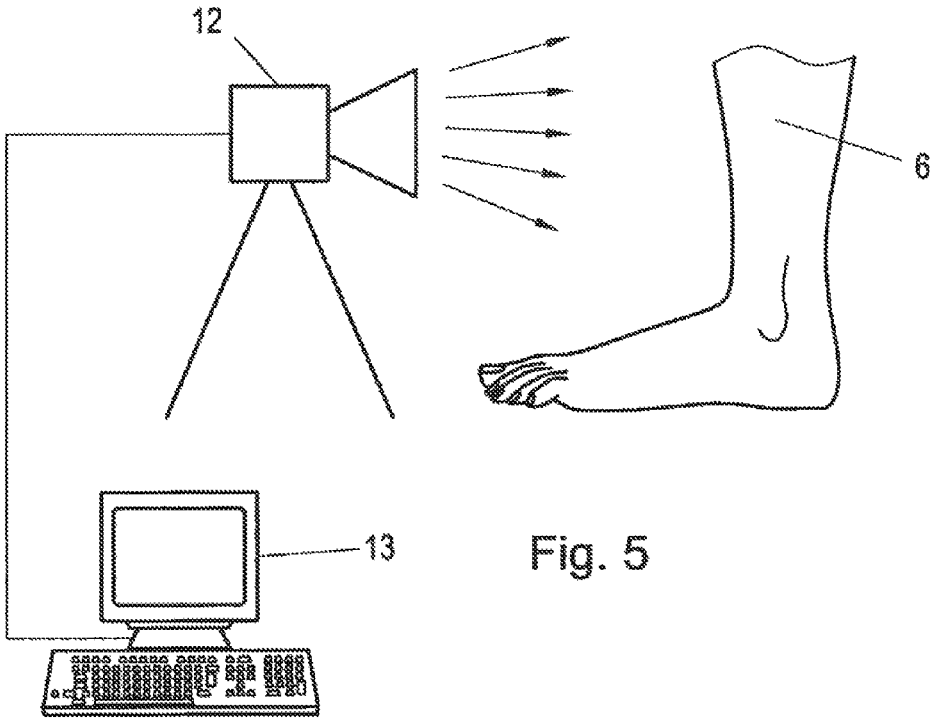
FIG. 5 shows, in a schematic manner, the recording of the shape of a human foot using an imaging camera and a computer, wherein image data are digitized and process so as to create the molded strip, namely an individual correction strip.

In detail, FIG. 5 shows an imaging camera or digitizing camera 12, by means of which the foot 6 of a wearer is photographed. The gathered digital data are fed to a computer 13 and are processed by said computer by means of a computer program, so that, when using the computer data for a strip production, an individual foot strip or last 15 that can be seen from FIG. 6, is attained. Said foot strip or last 15 can be made out of hard material, e.g. wood, for example by means of milling. This foot strip that is matched to an individual person, referred to as correction strip 15 hereinbelow, is inserted into a shoe 11, as is indicated in FIG. 6 by means of an arrow, wherein the shoe 11 is heated (see arrow W in FIG. 6), so that the shoe 11 becomes soft and so that the foot strip 15 can be inserted.

The digitizing camera 12 is not used for the production of images, as is the case in the common photography, but it is a system that provides the opportunity to convert the photographed object, in this case the shape of the foot of the wearer, into data points by means of the photographing, wherein an x-, y- and z-coordinate is assigned to each data point and it thus becomes possible to produce the photographed object in a 1:1 illustration in a three-dimensional manner by means of a computer-controlled machine, e.g. a milling device, in a simple manner.

Figure 6:
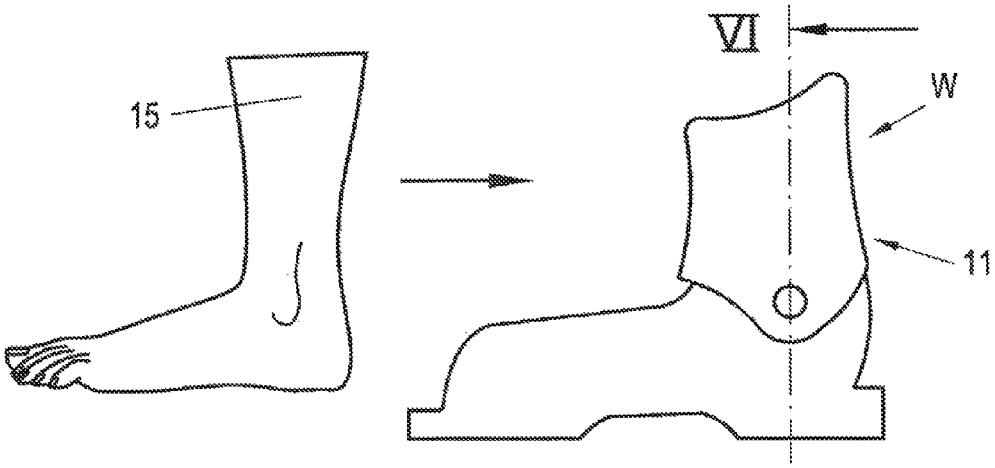
FIG. 6 shows such an individual correction strip comprising a shoe that is to be produced, that is, a prefabricated shoe that is to be adapted.

It can be seen from FIG. 6.1. that cavities 16 that had been left individually in the past, depending on the size of the foot or that had been filled by padding the inner shoe 3, respectively, remain at those locations where the correction strip 15 encompasses a smaller volume than the shoe 11. This is a disadvantage when engaging in sports. In addition, concentrated contact or pressure marks k remain, respectively, where the pressure oftentimes becomes relatively high in response to engaging in sports.

Provision is thus made according thereto for an adaptation of the shoe 11, so as to overcome these disadvantages and so as to eliminate cavities between correction strip and subshell as well as cuff, so that an exact fit is attained on the basis of a shoe shell that can be produced in a cost-efficient manner by means of retroactive process steps. The exact fit ensures that painful pressure marks are avoided on the one hand and that the transfer of force onto the sports equipment is optimized.

Figure 7:
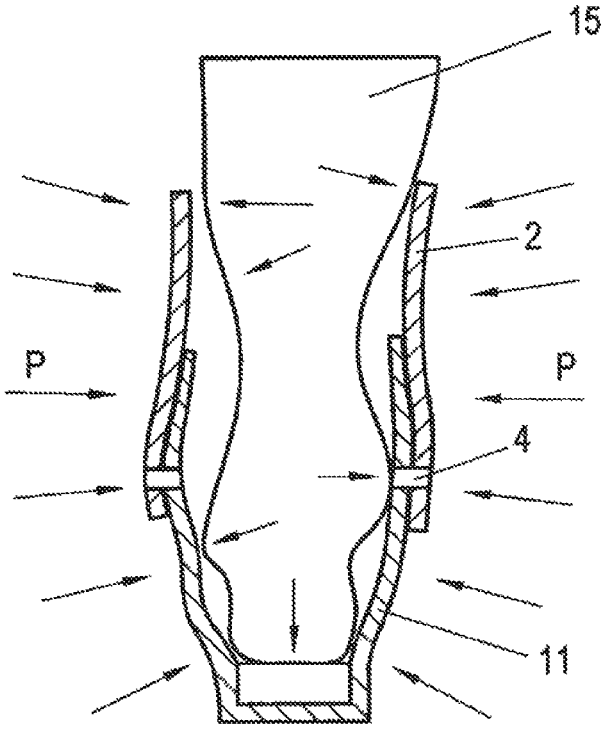
FIGS. 7 and 8 show different stages or details, respectively, for explaining the adaptation and production method, respectively, in sectional illustrations that are comparable to that of FIG. 6.1.

The principle of such a process can be seen from FIG. 7. According to FIG. 7, the correction strip 15 is inserted into the shoe 11 that has already been softened by means of heat exposure and the subshell 1 and the cuff 2 are pressed onto the correction strip 15 by means of an external (over)pressure P. After cooling down, the stiffened shoe 11 that has assumed the contour of the correction strip 15 is ready.

Figure 8:
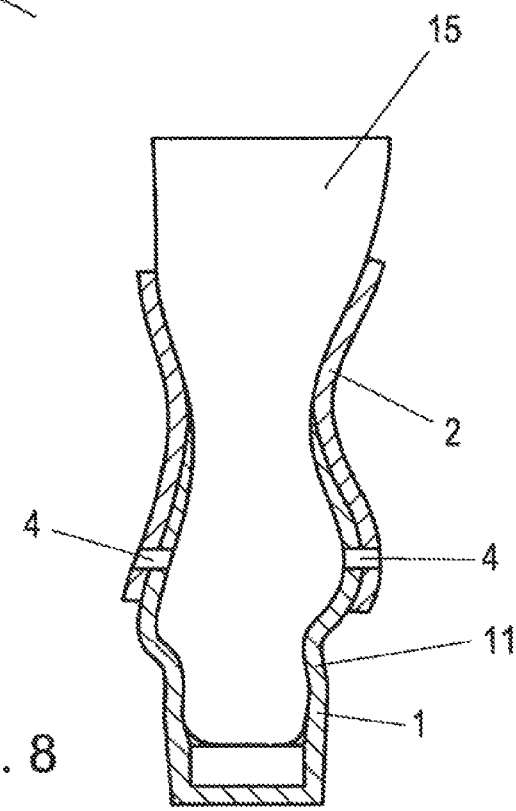

FIG. 8 shows a shoe 11 that has been (re)shaped in such a manner comprising a subshell 1 and a cuff 2 as well as the correction strip 15.

Figure 9:
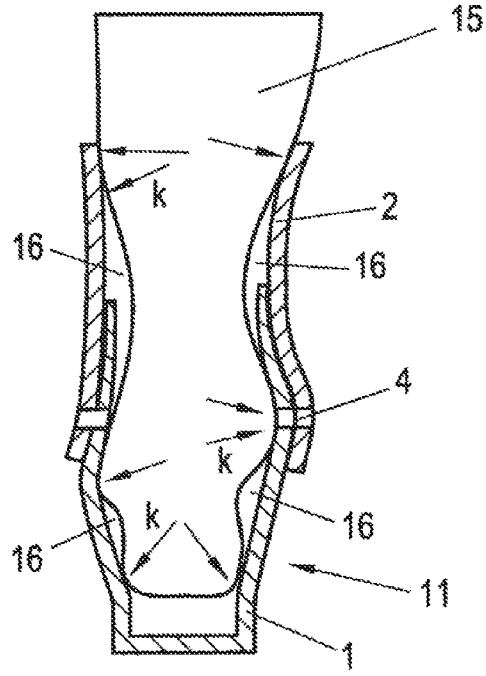
FIGS. 9 to 14 show different procedures or form tools, respectively, for illustrating different embodiments of the instant method.
Figure 9:
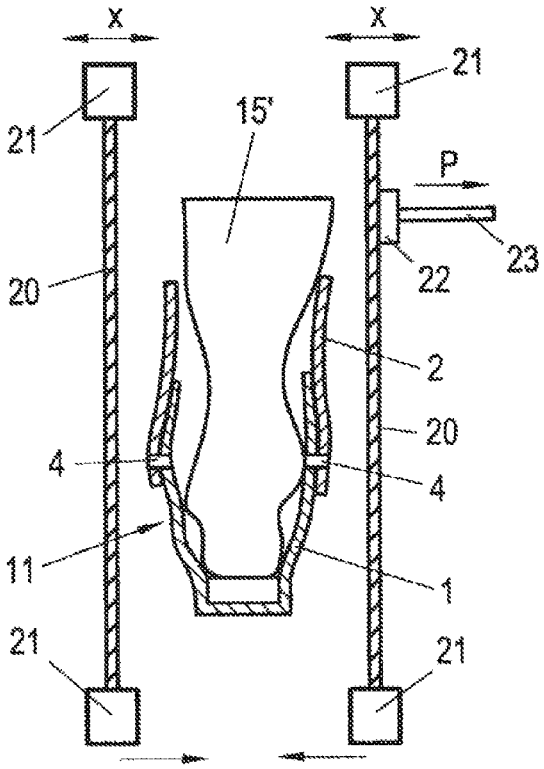
Figure 10:
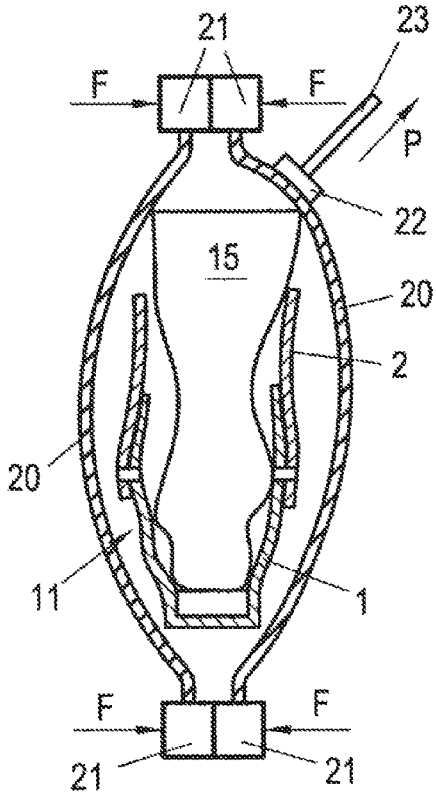
Figure 11:
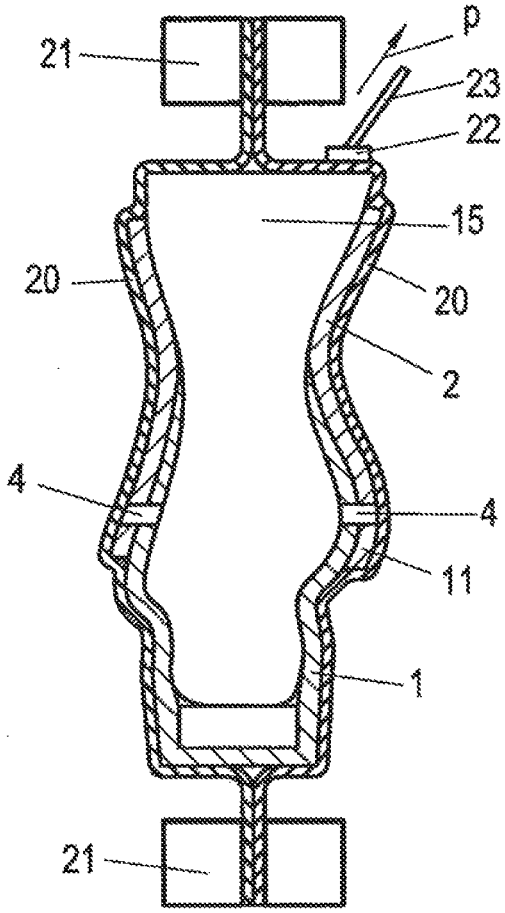
Figure 12:
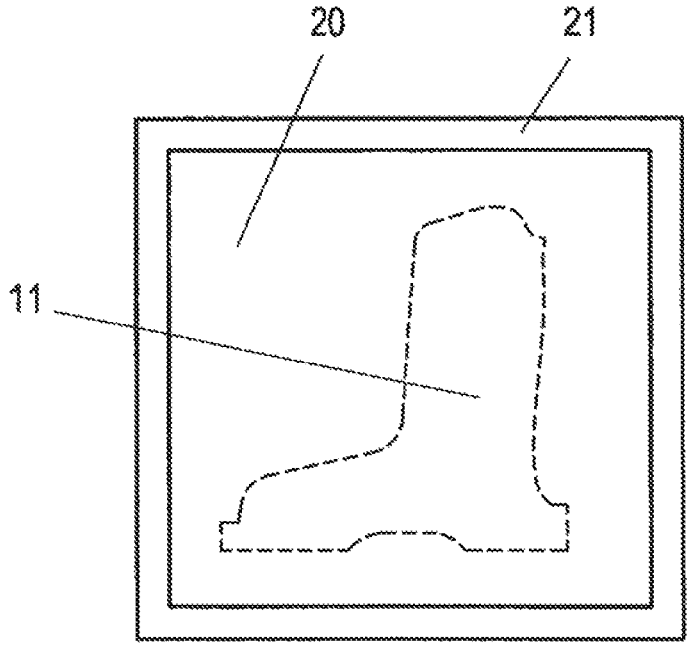

The method thus described in principle can be carried out, for example, by using a device according to FIGS. 9 to 12 comprising two membranes 20 and clamping frames 21. As is shown in FIGS. 9 and 10, the device has two clamping frames 21 that consist of steel, for example, and that can have a square shape as in the instant case (see FIG. 12). A membrane 20 made out of rubbery-elastic material is clamped in each of the two clamping frames 21, wherein a valve 22 comprising a hose 23 is affixed to at least one location on at least one of the two membranes 20. After the mold has been closed, as is indicated in FIG. 10, a low-pressure or a vacuum can be generated between the membranes 20 by means of said valve 22. As is indicated in FIG. 9 by means of double arrows x, the two clamping frames 21 comprising the membranes 20 can be moved towards and away from one another. The shoe 11, consisting of the subshell 1 and the cuff 2 connected by means of the joint 4, is held between the membranes 20 in that the clamping frame is turned by 90°, that is, it is used horizontally, and in that the shoe 11 is simply placed onto one of the membranes 20, so that the shoe 11 must not be held separately. The clamping frames 21 are pressed against one another by means of the force F after the correction strip 15 had previously been inserted into the shoe 11 that was softened by means of heat exposure, wherein the contact surfaces of the clamping frames 21 close in an air-tight manner. The membranes 20 thus fold around the shoe 11 like a balloon cover. In a third method step that is illustrated in FIG. 11, air is extracted in the direction of the arrow p by means of the hose 23, whereby the membranes 20 abut on the surface of the shell 1 and cuff 2 and press it onto the correction strip 15. The shoe 11 solidifies after a dwell time.

The autoclave technology that is used for producing fiber-reinforced synthetic material components comprising a three-dimensional surface provides a further production possibility. An advantage of this technology is that particularly simple, inexpensive tools can be used.

Figure 13:
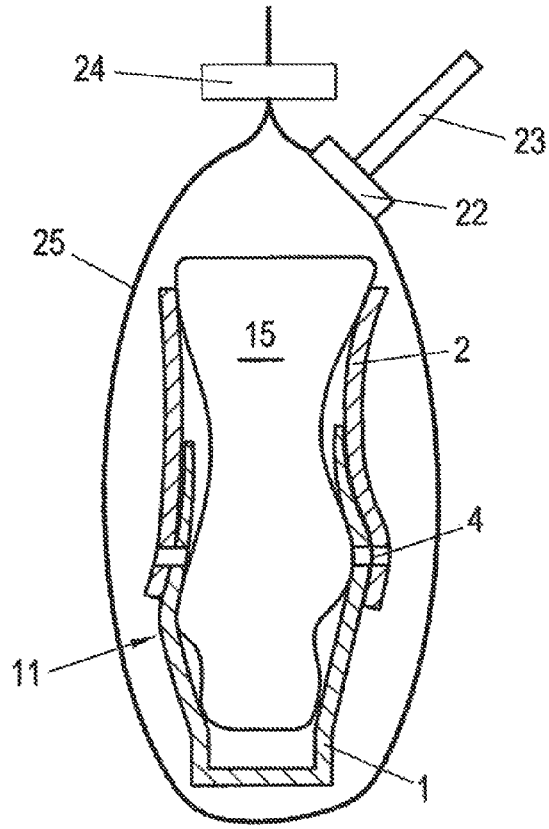

In the case of this production method, see FIG. 13, the subshell 1 with the cuff 2 and the correction strip 15 is enclosed by means of a thin film 25, preferably made out of synthetic material, and this film is closed by means of a closure 24.

Figure 14:
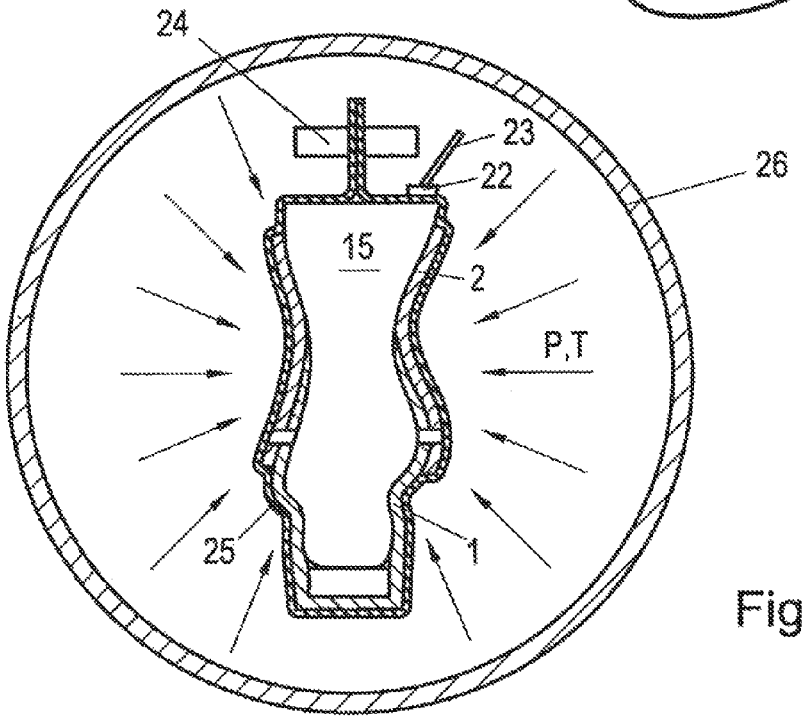

According to FIG. 14, for example, the autoclaves are substantially cylindrical hollow bodies 26, wherein one of them is indicated in FIG. 14 by means of a ring.

The use of the autoclave technology also has the advantage that, due to the large interior of the autoclave, many shoes 11 can be formed simultaneously, because the required individual "tool" herein is nothing more than a sack made out of a synthetic material film. Contrary thereto, the "tool" in the case of the method according to FIGS. 9 to 12 comprises the two clamping frames 21 with the membranes 20 and the additional devices, such as means for opening and closing the clamping frames 21, for example, means for compressing the clamping frames, etc.

According to FIG. 14, the interior of the autoclave hollow body 26 is pressurized and heated, as is indicated by means of arrows P and T, after the hollow body 26 has been closed at its ends, so that the film 25 abuts on the surface of the subshell 1 and of the cuff 2 and so that these parts 1, 2 are pressed onto the correction strip 15, wherein the interior of the film 25 is at the same time evacuated through the pipe 23.

The adapted stiff shoe made out of synthetic material is ready after the interior of the autoclave has cooled down.

The particular advantage of this method is that a plurality of shoes can be formed with simple means.

To attain a plastic deformation of the subshell 1, it is advantageous to bring it to a temperature, which is preferably at least 10° C. above the so-called softening temperature of the used synthetic material.

Figure 15:
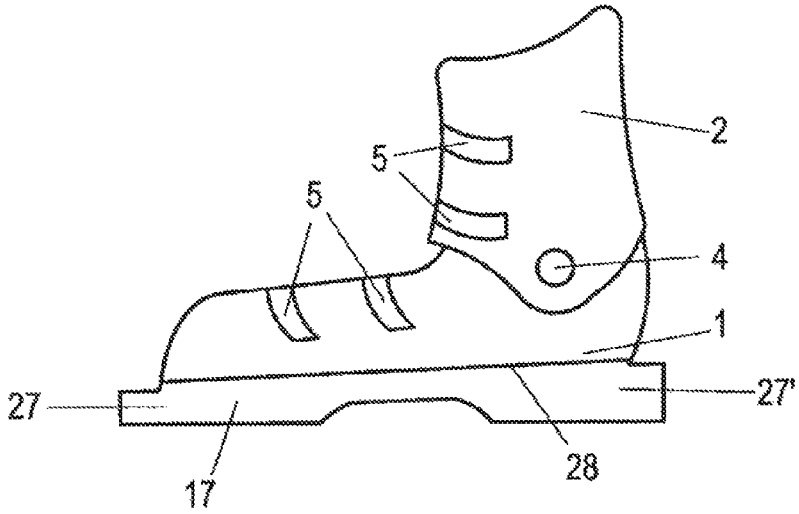
FIG. 15 shows a side view of a ski boot that encompasses a sole area comprising a higher softening temperature.

In the case of the shoe illustrated in FIG. 15, the subshell 1 has two areas 27 or 27', respectively, that cooperate with two separate fastening elements, a binding in the instant case and that have to encompass a so-called normal geometry to ensure the functionality of the binding.

In the case of the shoe according to FIG. 15, a two-component injection molding method is used for the production, in the case of which a synthetic material is used for the lower part 17 of the subshell 1, in particular for the areas 27 and 27', that is, substantially below line 28. Said synthetic material has a comparatively high softening temperature, e.g. 170° C. and a material that encompasses a considerably lower softening temperature, e.g. 100° C., is used for the shell 1 above line 28 as well as for the cuff 2, so that the entire shoe must only be heated to approx. 110 to 120° C. after the molding process, so that the upper part can be formed in a simple manner while the lower part 17 remains solid, thus maintaining its geometry.

Figure 16:
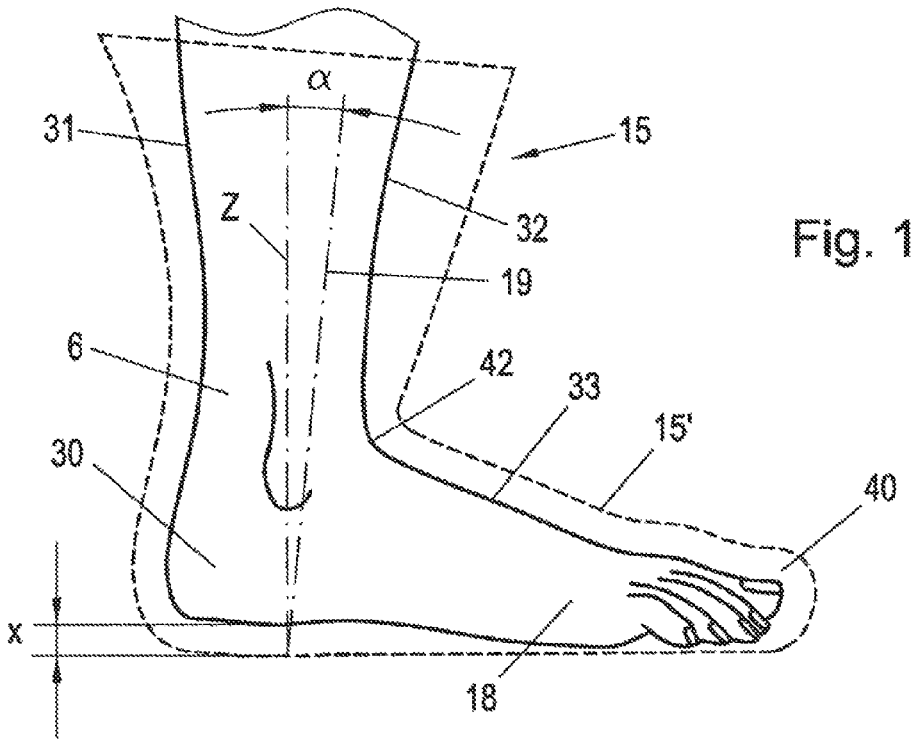
FIGS. 16 and 17 show, in a schematic side view and front view, a foot and matching this by means of dashed lines, a corresponding correction strip comprising a special contour and orientation.
Figure 17:
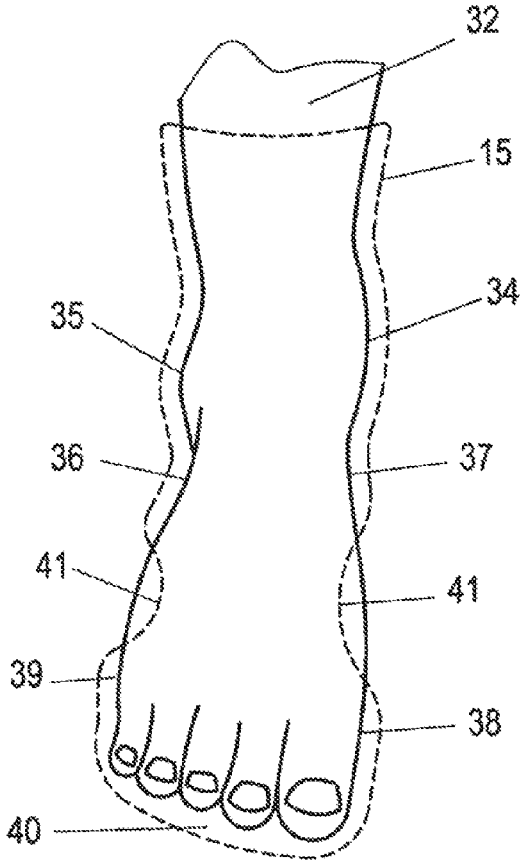

FIGS. 16 and 17 relate to a specific form of shoe adaptation, wherein FIG. 16 shows a side view and FIG. 17 shows a front view of a foot 6.

The dashed line in FIG. 16 illustrates the external envelope of the correction strip 15 relating to a solid line that illustrates the envelope of the leg or of the foot 6, respectively, of the wearer.

In the area of the calf 31 or of the shin 32, respectively, the correction strip 15 encompasses an excess towards the front and the back that runs upwards in a funnel-shaped manner from the bending area 42, as is illustrated in particular in FIG. 16. On the one hand, the space attained through this is used for a padded inner shoe tongue (3' in FIG. 1) in the shin area 32 as well as for a padding in the area of the calf 31. Bruises in the area of the rim of the shoe are thus avoided. This can in particular be seen from the side view in FIG. 16.

It can be seen from the view towards the front in FIG. 17 that the inner and outer side of the contour of the correction strip 15 runs parallel to the human leg in the area of the shin 32, thus attaining a stable lateral support that ensures a very direct force transfer in response to engaging in a sport on the one hand but also conveys an improved sense of balance on the other hand. The mentioned parallel contour continues across the inner ankle 34 and the outer ankle 35, wherein the contour of the correction strip 15 also runs parallel to the foot 6 in the area of the ball of the heel 30 (see FIG. 16).

A heel height can be incorporated into the correction strip 15, that is, the heel stands higher than the ball of the foot 18 relative to the ground by a measure x, as can be seen from FIG. 16.

The contour 15' of the correction strip 15 can run parallel to the foot 31 in the area of the instep 33, starting at the bend 42 up to the toe area. However, it is also possible to chose a different contour that is substantially oriented on the interior surface of the available shoe shell.

An advantageous feature of the correction strip 15 is present in the areas 41 that can be seen in FIG. 17. The correction strip 15 encompasses a contour that is narrower than the human foot in the areas 41 that are located in the metatarsal area, that is, between the navicular bone (os naviculare) 37 on the inside of the foot or the base bump 36 at the outside of the foot, respectively, and the ball of the large toe 38 or the ball of the small toe 39, respectively.

With this measure, the metatarsal area is compressed slightly, which does not cause pain due to the available jointed bone structure, but which creates a very good support effect from the side and also ensures that the heel 30 is held in its place during the engagement in the sport and cannot slip forward.

On the other hand, it is advantageous to provide for an excess in the area of the ball of the toes 38 and 39, so as not to cause pressure marks on the sensitive bones. It will furthermore be advantageous to arrange an excess in the area of the toes 40, so as to prevent frostbites. Due to the fact that the foot receptors are not blocked by the free space, the natural sense of balance is thus also maintained in the entire toe area 40.

Finally, an axis 19 comprising an angle $\alpha$ relative to a vertical axis Z can also be optionally available in the correction strip 15 (see FIG. 16), so as to set up an individual forward leaning.

Figure 19:
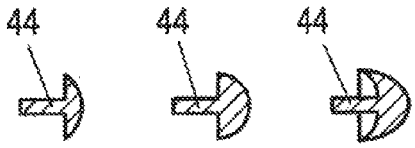
FIGS. 18 and 19 show, in a schematic illustration, a simple and economical possibility for the production of a correction strip comprising an individual adaptation to a foot by means of molded part that can be inserted.
Figure 18:
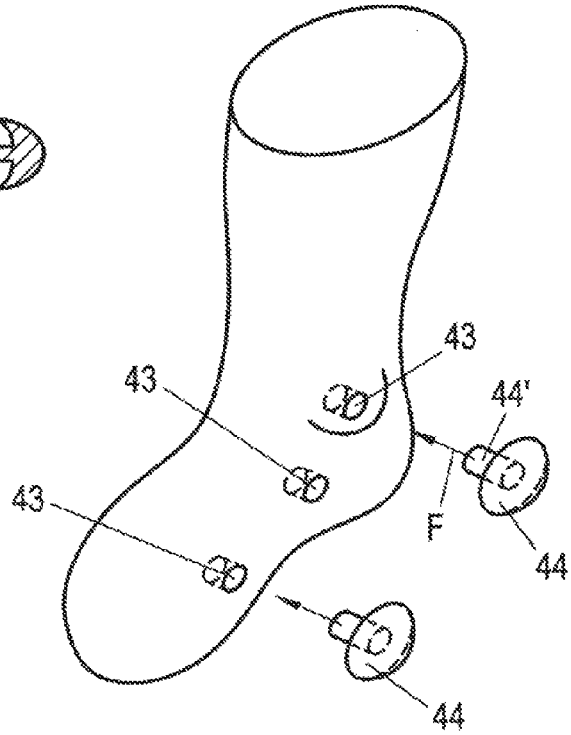

The correction strip 15 embodied as stand strip is provided with holes 43 at neuralgic spots in FIG. 18. The particularly algesic neuralgic spots on the foot are located on the inner and outer ankle, on the inner and outer ball points as well as on the navicular bone (os naviculare), on the base bump and on the ball of the heel. At these points, based on the individual foot of the wearer, molded parts 44 made out of synthetic material comprising an appendage 44' are inserted into the holes 43. Such synthetic material parts 44 are illustrated in FIG. 19 and are simply inserted into the available holes 43 of the synthetic material strip 15 in the direction of the arrow F in FIG. 18, in the instant case in the area of the inner ankle, for example.

The parts 44 are preferably produced by means of a synthetic material injection molding method, wherein it has become apparent that a certain elasticity is particularly advantageous for the molding process. Accordingly, materials from the group silicon elastomers as well as thermoplastic elastomers in a Shore hardness range D of between 45 and 65 are preferably suitable.

An advantage of this alternative is that one set of base strips is produced for each shoe size and a great many different feet can be imaged by means of a type of construction kit system comprising different synthetic material parts.

Figure 20:
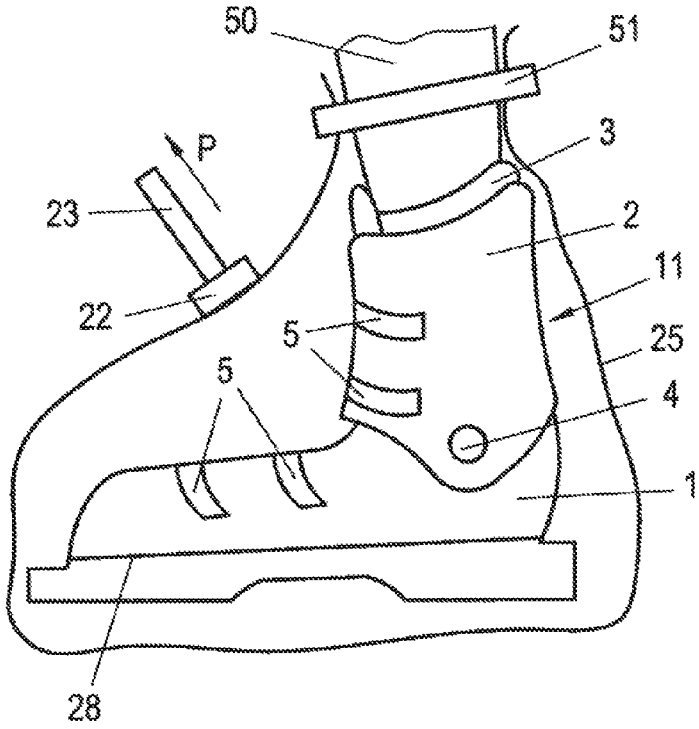
FIGS. 20 and 21 show, in a schematic side view, two method steps in the case of a further advantageous embodiment of the instant method for individually adapting the shoe to a foot of a wearer.

The method for producing or adapting the shoe 11 illustrated in FIGS. 20 and 23 has also proven to be particularly advantageous.

Preferably, a shoe 11 according to FIG. 15 is used for the adaptation to the individual foot, that is, a shoe in the case of which the lower area 17, substantially below line 28, consists of a material that encompasses a high softening point, e.g. 150° C., whereas a synthetic material that encompasses a relatively low softening temperature, e.g. 60 to 80° C., is used for the upper area of the shell 1 as well as for the cuff 2. It is then possible without any difficulties to directly use the leg 50 or the foot 6, respectively, of the wearer instead of the correction strip 15 for the molding. This takes place in that the shoe 11 is heated to a temperature of 60 to 80° C., the wearer steps with the leg 50 (or foot 6, respectively), if need be with the additional use of a common thermo-sock, with the inner shoe 3 into the shoe 11 according to FIG. 20, a film 25 in the form of a sack being placed over the entire shoe 11, similar as in the case of the use of the autoclave technology according to FIGS. 13 and 14, e.g., and this film 25 being attached to the calf of the leg 50 of the wearer above the upper rim of the shoe 11 by means of a suitable fastening means, for example an adhesive strip 51.

At a suitable location, e.g. in the front cuff area, the film sack 25 is thereby provided with a valve 22 and a hose 23 by means of which low-pressure or vacuum, respectively, can be applied along the arrow P, that is, air can be extracted so as to evacuate the interior of the film sack 25.

Figure 21:
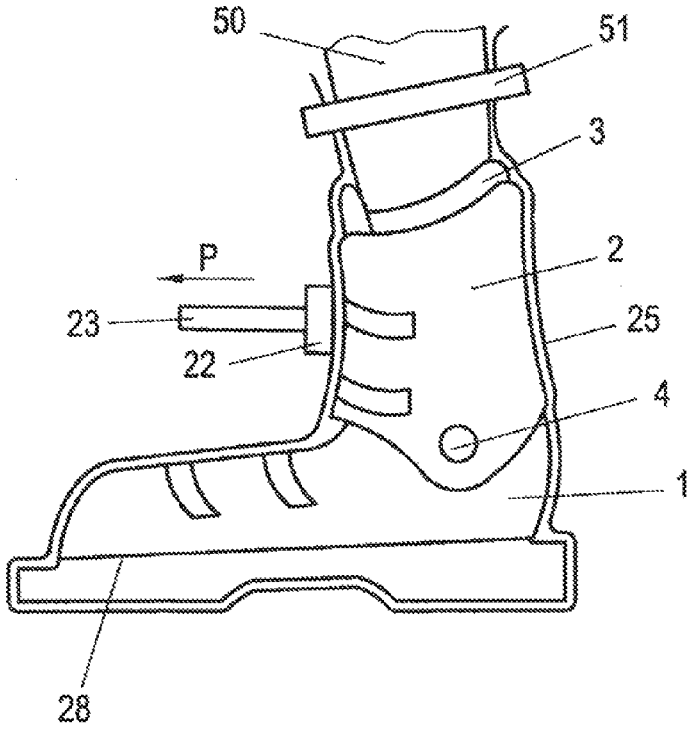

As is shown in FIG. 21, the film 25 is thus placed accurately on the surface of shell 1 and cuff 2 and presses the upper part of the shell 1 above line 28 and the cuff 2 onto the leg 50 of the wearer, adapting to the contour thereof.

The film 25 is removed after a certain dwell time, which is required to cool down the synthetic material to below the softening temperature and the shoe 11 is integrally molded directly to the leg 50 of the wearer.

The invention claimed is:

1. A method for producing a shoe to be adapted to a foot of a wearer, to be made of hard, thermoplastic synthetic material and to be worn for sports, the method comprising the following steps:

heating a prefabricated shoe at least in sections to produce a heated area;

introducing a correction last made of hard material and taken from the foot of the wearer into the prefabricated shoe;

adapting the prefabricated shoe by shaping the heated area by applying pressure from the outside to press the heated shoe onto the correction last, the adapting including the following steps:

placing a film entirely over the prefabricated shoe and the correction last;

closing the film;

evacuating an interior of the film to press the shoe onto the correction last; and removing the shoe after a dwell period for solidification of the synthetic material; and subsequent to adapting, cooling the shoe.

2. The method according to claim 1, which further comprises providing the shoe with a sole area and a remaining area, and using a material having a relatively higher softening temperature for the sole area and a material having a relatively lower softening temperature for the remaining area.

3. The method according to claim 2, wherein the relatively higher softening temperature is approximately 170° C. and the remaining area includes a shell and a cuff.

4. The method according to claim 1, wherein the correction last is narrower when measured than the foot of the wearer between the respective navicular bone at the inside of the foot or the base bump at the outside of the foot, and the respective area of the ball of the large toe or the area of the ball of the small toe.

5. The method according to claim 1, which further comprises providing an over-dimensioning to the correction last in the area of the ball of the toes.

6. The method according to claim 1, which further comprises providing excess space in the area of the toes of the prefabricated shoe.

7. The method according to claim 1, which further comprises providing the correction last with an axis disposed at an angle relative to a vertical axis to enable leaning forward.

8. The method according to claim 1, which further comprises providing the correction last as a base correction last having holes at neuralgic spots and molded elastic parts inserted into the holes.

9. The method according to claim 1, which further comprises obtaining a shape of the correction last by scanning the foot of the respective wearer with a digitizing camera and processing data obtained from the scanning in a computer.

10. The method according to claim 1, wherein the heating of the prefabricated shoe precedes the introducing of the correction last.

11. A method for producing a shoe to be adapted to a foot of a wearer, the method comprising the following steps:

providing a prefabricated shoe made of hard, thermoplastic synthetic material;

heating the prefabricated shoe at least in sections to produce a heated area;

subsequent to the heating step, introducing a correction last made of hard material and taken from the foot of the wearer into the prefabricated shoe;

adapting the prefabricated shoe by shaping the heated area by applying pressure from the outside to press the heated shoe onto the correction last, the pressure being applied by placing a film entirely over the prefabricated shoe and the correction last, closing the film, evacuating an interior of the film to press the shoe onto the correction last, and removing the shoe after a dwell period for solidification of the synthetic material; and cooling the shoe.

* * * * *